US005439223A

United States Patent [19]

Kobayashi

[11] Patent Number: 5,439,223

[45] Date of Patent: Aug. 8, 1995

[54] GOLF CLUB HEAD

[76] Inventor: Kenji Kobayashi, 1845, Ohaza-Higashiohta, Tsubame-shi, Niigata-ken, Japan

[21] Appl. No.: 41,449

[22] Filed: Apr. 1, 1993

[30] Foreign Application Priority Data

| | | | |
|---|---|---|---|
| Apr. 2, 1992 | [JP] | Japan | 4-081052 |
| Apr. 6, 1992 | [JP] | Japan | 4-084216 |
| Apr. 7, 1992 | [JP] | Japan | 4-085727 |
| Apr. 8, 1992 | [JP] | Japan | 4-087305 |
| Apr. 9, 1992 | [JP] | Japan | 4-089075 |
| May 1, 1992 | [JP] | Japan | 4-112872 |
| Dec. 18, 1992 | [JP] | Japan | 4-339134 |
| Dec. 18, 1992 | [JP] | Japan | 4-339135 |

[51] Int. Cl.[6] ..... A63B 53/04

[52] U.S. Cl. ..... 273/169; 273/167 H; 273/173

[58] Field of Search ..... 273/167 R, 167 A, 167 F, 273/167 G, 167 H, 169, 171, 172, 173, 174

[56] References Cited

U.S. PATENT DOCUMENTS

| | | | |
|---|---|---|---|
| 1,257,471 | 2/1918 | Fitzjohn | 273/167 A |
| 2,328,583 | 9/1943 | Reach | 273/171 |
| 2,332,342 | 10/1943 | Reach | 273/171 |
| 2,447,967 | 8/1948 | Stone | 273/164.2 |
| 4,630,827 | 12/1986 | Yoneyama | 273/169 |
| 4,687,205 | 8/1987 | Tominaga | 273/169 |
| 4,754,969 | 7/1988 | Kobayashi | 273/78 X |
| 4,809,978 | 3/1989 | Yamaguchi | 273/173 |
| 4,824,110 | 4/1989 | Kobayashi | 273/169 |
| 4,852,880 | 8/1989 | Kobayashi | 273/167 F |
| 4,883,275 | 11/1989 | Boone | 273/167 H |
| 4,964,640 | 10/1990 | Nakanishi | 273/173 |
| 5,062,638 | 11/1991 | Shira | 273/167 R |
| 5,176,384 | 1/1993 | Sata | 273/167 R |
| 5,184,823 | 2/1993 | Desbiolles | 273/167 H |

OTHER PUBLICATIONS

U.S. patent application Ser. No. 887,735.

*Primary Examiner*—Sebastiano Passaniti
*Attorney, Agent, or Firm*—Quarles & Brady

[57] ABSTRACT

In order to enlarge a sweet area on a ball hitting surface of a golf clubhead, composite structures of two different specific gravities are utilized in addition to structural devices for fixing composite parts. The center of gravity of a golf clubhead is capable of being further distant from a face by utilizing said composite structures, for example, a balance weight fitted into a head body, a face fitted into a head body, a window-like hole provided in a head body etc. In the case of fitting a face into a head body, the specific gravity of said face is smaller than that of a head body, which is provided with a window-like hole, and/or a back crust therein, whereby golf clubheads with ultra wide sweet area can be obtained.

6 Claims, 9 Drawing Sheets

GOLF CLUB HEAD

BACKGROUND OF THE INVENTION (a) Field of the Invention

The present invention relates to a golf clubhead of so-called "iron golf club head" and its manufacturing method.

(b) Description of Prior Art

Iron golf clubheads have heretofore been manufactured by forging iron to form a sole part, a face part inclined at predetermined angle to said sole part, a neck part or shaft attaching part hollowed out to fit a shaft therein, which have been polished to a final product. Such clubheads of prior art have been designed to enlarge so-called "sweet area", i.e., ball hitting area of face on which balls are hit at relatively regular angles, which is conventionally attained by means of projecting the back of sole part still toward the back, whereby the center of gravity of clubhead is positioned back to lengthen the distance between said center of gravity and the face part, so that said sweet area is capable of being enlarged. According to such prior art, however, there have been some limits of enlarging said "sweet area".

To overcome such limits, there is proposed one representative of prior art with a composite structure disclosed in U.S. patent application Ser. No. 887735, which utilizes a composite structure of two different balance weight densities to transfer balance weight from the hosel and heel to the ball-impact region of the head. That is, the hosel and a portion of the toe are made of a material of a first weight density, and the sole, backweight, remainder of the toe and a majority of the front surface are made of a second weight density, whereby the weight distribution of said head is the greatest adjacent the center of said front surface.

However, it is desirable that the distance between the center of gravity of the head and the ball-impact face is still elongated to provide such clubheads as have "wider sweet area". And in accordance with said prior art of merely structuring members of different specific gravities, it is impossible to provide a golf clubhead having "ultra wide sweet area".

SUMMARY OF THE INVENTION

It is, therefore, an object of the present invention to provide a golf clubhead having ultra wide sweet area so that hitting mistakes may be further decreased.

It is another object of the present invention to provide a method of manufacturing such clubheads as have above-described ultra wide sweet area.

According to a major feature of the present invention, a golf clubhead is composed of beryllium copper alloy or the like of comparatively large specific gravity and titanium alloy or the like of comparatively small specific gravity, whereby the center of gravity of a clubhead is transferred to a backward position near the sole. The center of gravity can be positioned further backward adjacent the sole part by means of fitting a balance weight with a large specific gravity into a head body, and/or fitting a face member with a small specific gravity into an opposed window-like hole provided in a head body, and /or forming a back crust in a head body or a combination thereof.

BRIEF DESCRIPTION OF THE DRAWINGS

Other objects, features and advantages of the invention will be apparent to those skilled in the art from the following description of the preferred embodiments of the invention, wherein reference is made to the accompanying drawings, of which.

DETAILED DESCRIPTION OF THE PREFERRED EMBODIMENTS

Figure 1:
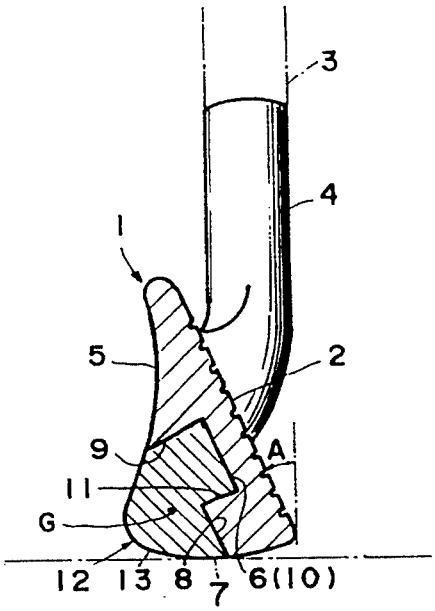
FIG. 1 is a section showing a clubhead structure of according to the first embodiment of the present invention.

The several embodiments of golf club heads described below have certain features in common, and the following descriptions employ common directional words relating to those features. The face 2 of the head 1, which is the part intended to hit the ball, is located on the "front" of the head 1. The terms "top" and "bottom" assume that the club head 1 is oriented as it would be if the golf club were held by a golfer in an at rest position. The sole 13 is the bottom of the head 1, the part which may contact the ground. The heel 20 side is located "laterally" opposite the toe 19 side. The top of head 1 is "longitudinally" opposite the sole 13 The terms "width", "wide" and "narrow" refer to a dimension extending longitudinally. The terms "height" and "depth" refer to a dimension extending front to back.

Figure 2:
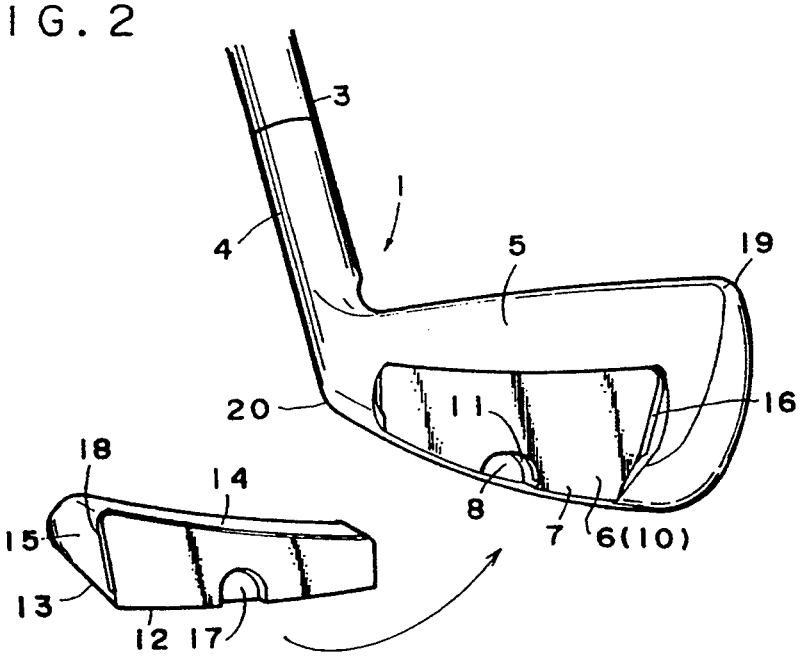
FIG. 2 is an exploded perspective view showing the structure of the first embodiment.

FIGS. 1 to 2 show the first embodiment of the present invention. Head 1 made of titanium or titanium alloy (with a specific gravity of approximately 4.5) is provided with face 2 inclined at a predetermined angle A to vertical axis. On one side of said head 1 is mounted hosel or shaft attaching portion 4 to attach shaft 3 thereto. In the lower half of back part 5 of said head 1 is formed with recess 6, of which the lower part is aperture 7 having semicircular protrusion 8 therein, as shown in FIG.2. The upper surface 9 of said recess 6 is so formed that an overall width thereof may increase toward bottom part 10. And so is side 11 of said protrusion 8. Balance weight 12, made of beryllium copper alloy (with a specific gravity of approximately 8.2) or stainless steel (with a specific gravity of approximately 7.9), has a lower surface which forms part of sole 13 and has an upper surface 14 and a side surface 15 which are formed so that they may substantially correspond to said upper surface 9 and side surface 16 when fitted into recess 6. At the lower part of said balance weight 12 is provided semicircular recess 17 corresponding to said semicircular protrusion 8. Further, shallow groove 18 is formed in the edges of said upper surface 14 and side surface 15 of balance weight 12. Reference numeral 19 designates a toe of head body 1 and numeral 20 designates a heel thereof. In the case of fixing said weight 12 to head 1, said weight 12 is pressed into said head 1 and integrated therewith by means of a press device. Since a golf club iron head is thus constructed, the center of gravity G of head 1 becomes distant from face 2 and is positioned near sole 13 of weight 12 having larger specific gravity than head 1, whereby the distance between said center of the gravity G and face 2 becomes longer so that such clubheads as have wider sweet area can be provided. Moreover, as said head 1 is made of titanium or titanium alloy, while said weight 12 is made of beryllium copper alloy or stainless steel with a specific gravity nearly 1.8 times that of head 1, whereby the center of gravity can be transferred still backward and downward so that such clubheads as have "ultra wide sweet area" can be provided.

Figure 3:
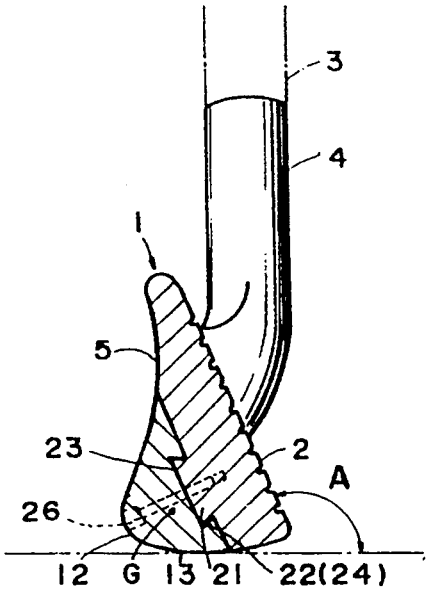
FIG. 3 is a section showing a clubhead structure of the second embodiment of the present invention.
Figure 4:
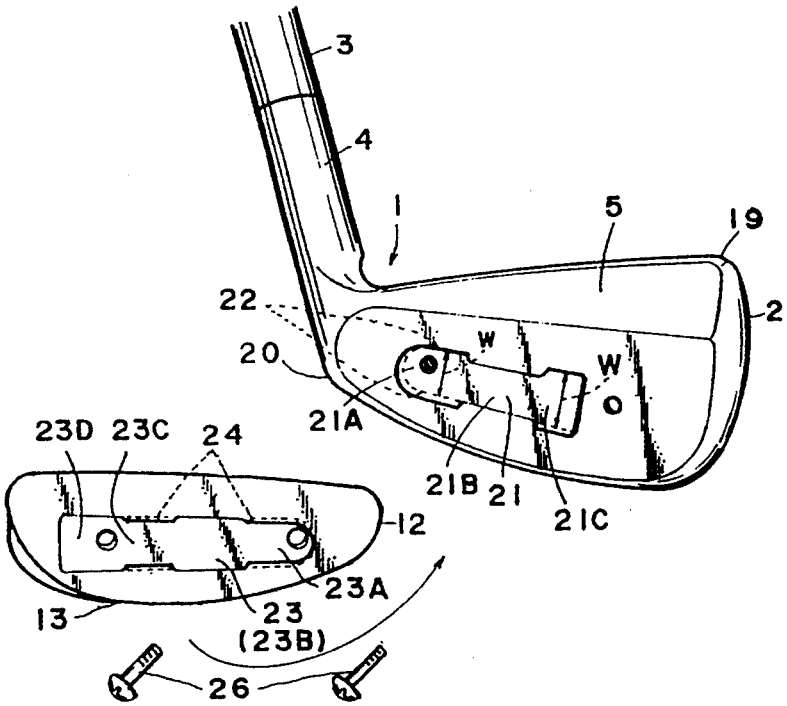
FIG. 4 is an exploded perspective view showing the clubhead structure of the second embodiment.

In FIGS. 3 to 4 showing a golf clubhead structure of the second embodiment, the same portions as those of the forgoing embodiment are designated as the common reference numerals, and their repeated detail description will be omitted.

Head 1 made of titanium or titanium alloy is provided with face 2 inclined at a predetermined angle A. On one side of said head 1 is mounted shaft attaching portion 4 to attach shaft 3 thereto.

At the back of head 1 forming face 2 made of titanium or titanium alloy is provided dovetail tenon 22 to fix balance weight 12 made of beryllium copper alloy or stainless steel thereto. As shown in FIG.4, there is laterally provided convex portion 21, of which the longitudinal width W tapers toward heel 20. The upper and lower sides of said convex portion 21 form broad (i.e., wide) areas 21A and 21C and narrow area 21B between them. The upper and lower edges of said broad areas 21A and 21C are angled or otherwise shaped so that these areas have dovetail tenon shapes and together form dovetail tenon 22. On the other hand, the fitting surface of balance weight 12 is laterally provided with concave portion 23 which is formed approximately of the same depth and size so as to be fitted into said convex portion 21. Accordingly, said concave portion 23 is formed with narrow area 23A fitted near said shaft attaching portion 4, and then there are formed in sequence broad area 23B, narrow area 23C and broad area 23D. The upper and lower edges of said narrow areas 23A and 23C are angled or otherwise shaped to that these areas have dovetail mortise shapes and together form mortise 24. In fitting said concave portion 23 into said convex portion 21, said broad area 21A is to be inserted into said broad area 23B, narrow area 21B into narrow area 23C, and broad area 21C into broad area 23D respectively as well. After said convex broad areas are inserted into said concave broad areas, and said narrow concave area is inserted into said concave narrow area, weight 12 is laterally shifted so that said narrow area 23A may correspond to said broad area 21A, whereby broad area 21A is opposed to narrow area 23A, narrow area 21B to broad area 23B, and broad area 21C to narrow area 23C respectively so as to fit dovetail tenon 22 into dovetail mortise 24. Consequently, weight 12 is firmly fixed to head 1 by means of dovetail joint of mortise 24 with tenon 22, and wedge type fitting of said convex portion 21 into concave portion 23, which are finally ensured to be secured to each other by screw 26.

Since balance weight 12 with more specific gravity than head 1 is thus formed and fixed to head 1, the center of gravity is transfered to the part of weight 12 adjacent sole 13, whereby the distance between the center of gravity G and face 2 is elongated so that clubheads with "extra wide sweet area" can be provided. Further, said dovetail joint and the wedge-type fitting make it possible to so firmly secure head 1 to balane weight 12.

Figure 5:
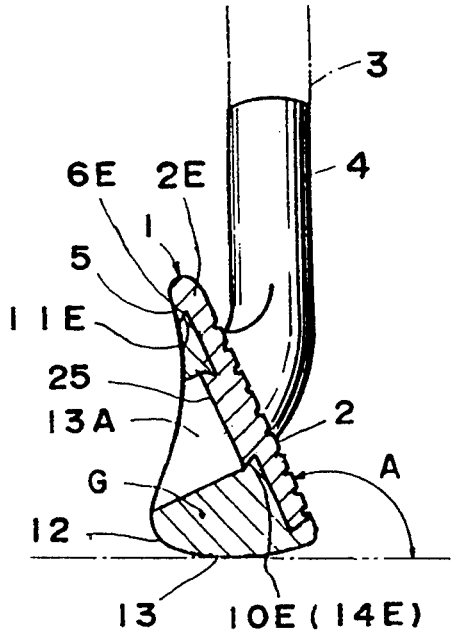
FIG. 5 is a section showing a clubhead structure of the third embodiment of the present invention.
Figure 6:
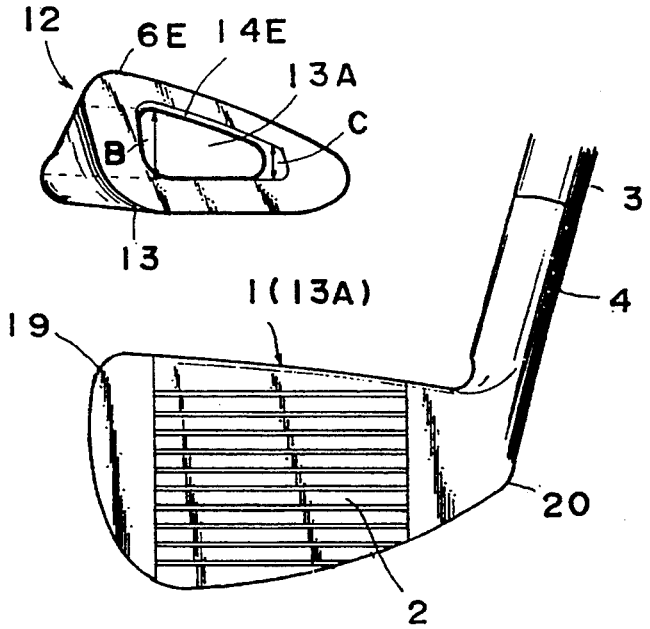
FIG. 6 is an exploded perspective view showing the structure of the third embodiment.

In the third embodiment shown in FIGS. 5 to 6, there is provided thin plate 2E, of which the surface is formed with face 2. Approximately in the center of back surface 5 thereof is laterally formed dovetail convex portion 25, of which the longitudinal width generally increases from heel 20 toward toe 19. And In the upper part of said back surface 5 of head body 1 is formed stepped edge 6E.

The approximate center of balance weight 12 is formed with window-like hole 13A, of which the peripheral edge 14E diminishes its (i.e., the hole 13A's) longitudinal width toward face 2 so that said balance weight 12 is firmly fitted into the corresponding peripheral edge 10E of convex portion 25. Additionally, the longitudinal width of said peripheral edge 14E is formed longer at the toe 19 side than at the heel 20 side, as indicated with letter B, C in FIG. 6. And overall width of said peripheral edge 14E is formed slightly smaller than that of said peripheral edge 10E. The upper edge 11E of said weight 12 formes a dovetail tenon so that said upper edge 11E is fitted into said edge surface 6E of head body 1. Thereafter, into the back surface 5 of head body 1 is press-fitted the front surface of weight 12 with said edge surface 10E forced into edge surface 14E, said edge surface 6E fitting into upper edge surface 11E respectively, whereby head body 1 is integrally fixed to weight 12 by means of dovetail joint.

Since weight 12 with more specific gravity than head 1 is thus formed and fixed thereto, the center of gravity is transferred to the weight 12 side adjacent sole 13, whereby the distance between the center of gravity G and face 2 is elongated so that clubheads with "extra wide sweet area" can be provided. Further, said dovetail joint of head 1 with weight 12 makes it possible to firmly secure head body 1 to weight 12. Furthermore, as the longitudinal width of said peripheral edge 14E is formed longer at the toe 19 side than at the heel 20 side, and the longitudinal width of convex portion 25 generally increases from the heel 20 side toward the toe 19 side, the centrifugal force can be overcome when a golf club is swung.

Figure 7:
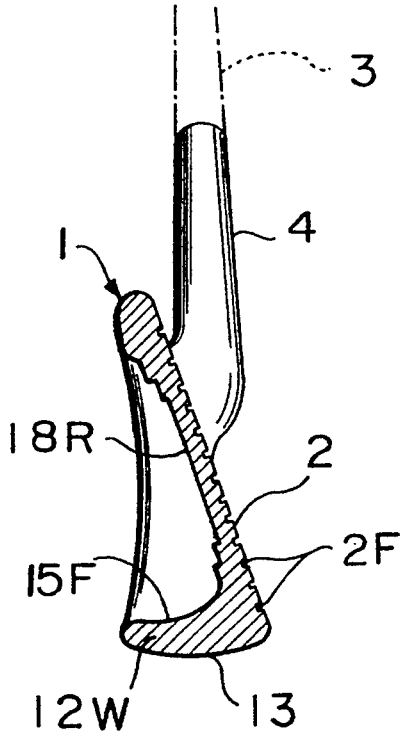
FIG. 7 is a section showing a clubhead structure according to the fourth embodiment of the present invention.
Figure 8:
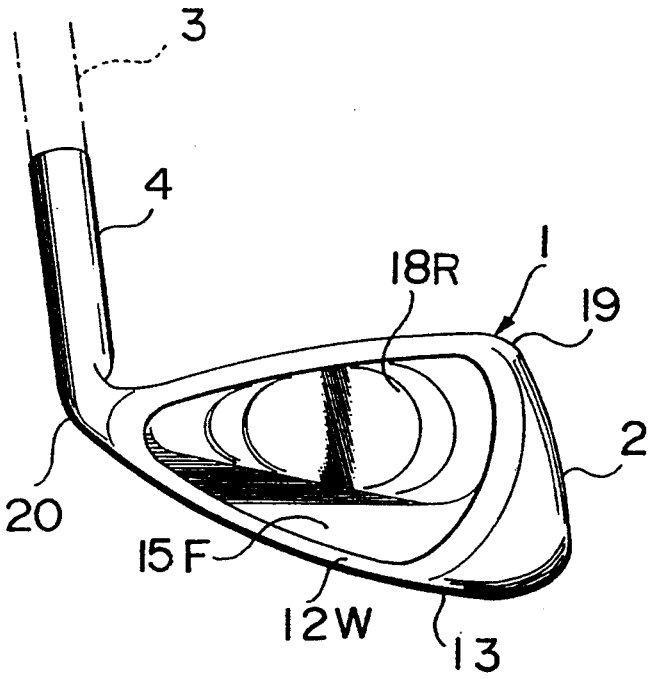
FIG. 8 is a perspective view showing the structure of the fourth embodiment.
Figure 9:
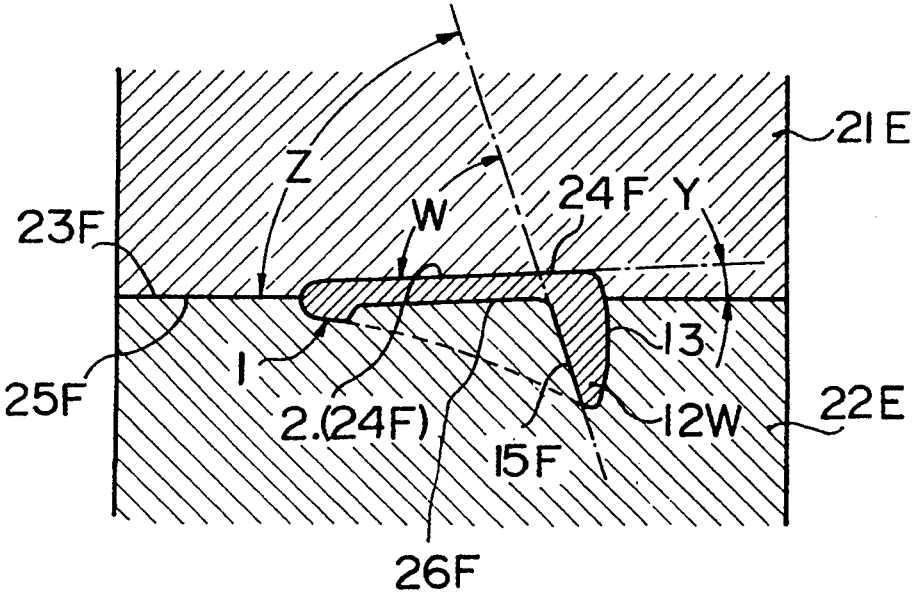
FIG. 9 is a section showing a die structure of the fourth embodiment.

In FIGS. 7 to 9 showing the fourth embodiment of the present invention, there is provided head body 1 having face 2 formed with a plurality of horizontally parallel grooves 2F. The lower part of said face 2 is formed with sole 13 with balance weight 12W projected toward the back.

Said face 2 can be inclined at predetermined angles to sole 13 in accordance with the kinds of clubheads. From heel 20, there extends upward shaft attaching portion 4 for attaching shaft 3 thereto. The back surface of face 2 is formed with shallow multistage recesses 18R. Reference numeral 19 designates the toe of head body 1.

FIG. 9 shows upper die 21E and lower die 22E utilized in the case of forging head 1. To form said face 2 and a part of sole 13 adjacent face 2, there is provided engraved surface 24F on boundary surface 23F of said upper die 21E, wherein engraved surface 24F provided for forming said face 2, a part of sole 13 inclines at an angle Y to said boundary surface 23F. On the other hand, boundary surface 25F of said lower die 22E is formed with engraved surface 26F provided for forming the back surface of said face 2, the remainder of said sole 13, and balance weight 12W respectively, wherein the upper surface 15F of balance weight 12W is inclined at an angle Z to said boundary surface 25F, to avoid undercut thereof.

With the structure thus made, heated lump of metal material such as soft iron or stainless steel is placed in said lower die 22E separated from said upper die 21E. Thereafter, said pair of dies are brought near to contact each other to be pressurized, so that said metal material is forged to form head 1. Since face 2 is inclined at angle Y, angle W of said upper surface 15F to face 2 is equal to angle angle Z+angle Y, in spite of said upper surface 15F being inclined at angle Z to said boundary surface 25F.

Incidentally, shaft mounting portion 4 is formed by a part of cavity (not shown).

Figure 10:
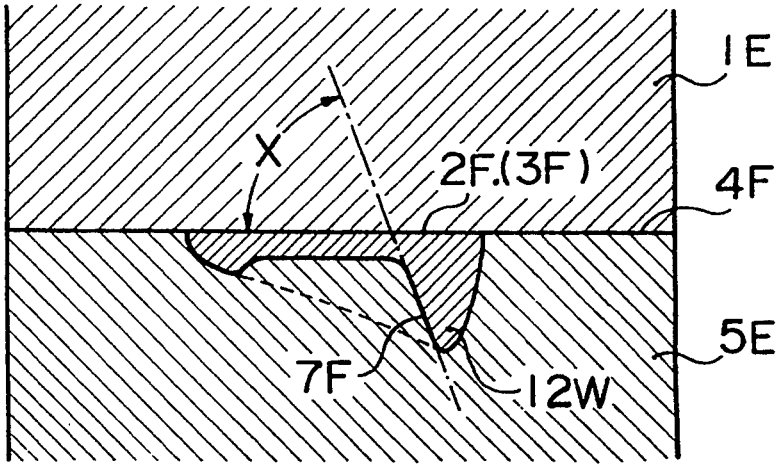
FIG. 10 is a section showing a die structure of a prior art.

To clarify the advantages of thus constructed embodiment of the present invention, one of the prior art is shown in FIG. 10, wherein a heated metalic material is set in a cavity to forge it by pressurizing upper die 1E and lower die 5E, thereafter the forged product is taken out to be deburred, polished or the like to a final product. The prior art is characterized in that upper surface 7F of weight 12W is inclined at an angle X to avoid making undercut therein so that weight 12W can be easily taken out of lower die 5E after forging.

According to this prior art, however, the back of weight 12W is not able to be cut out at its lower part in a large measure. Accordingly, the center of gravity of weight 12W cannot be further lowered, so that the center of gravity of the head is not able to be positioned at a further backward point. Consequently, there have been a manufacturing limit of enlarging the sweet area of a golf clubhead.

To overcome above-described problem, the fourth embodiment with above-described structure allows weight 12W to be forged without undercut, mainly because upper die 21E is available for forming face 2 and a part of sole 13 adjacent said face 2, while lower die 22E is available for forming said weight 12W and the remainder of sole 13. Further, said angle Z of upper surface 15F of weight 12W relative to face 2 can be made larger, whereby the back of weight 12W is able to be cut out at its lower part in a large measure. Accordingly, the center of gravity of weight 12W can be further lowered so that it may be positioned at a further backward point which is distant from face 2 and is adjacent sole 13. Consequently, there can be provided a golf clubhead of which the sweet area can be enlarged.

Figure 11:
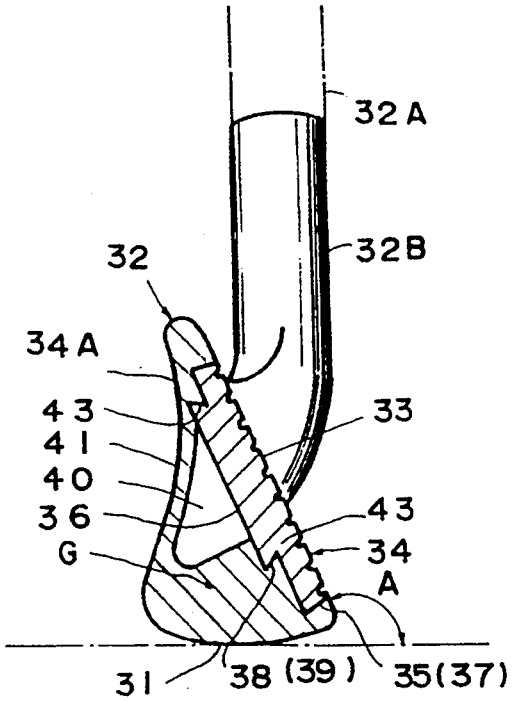
FIG. 11 is a section showing a clubhead structure according to the fifth embodiment of the present invention.
Figure 12:
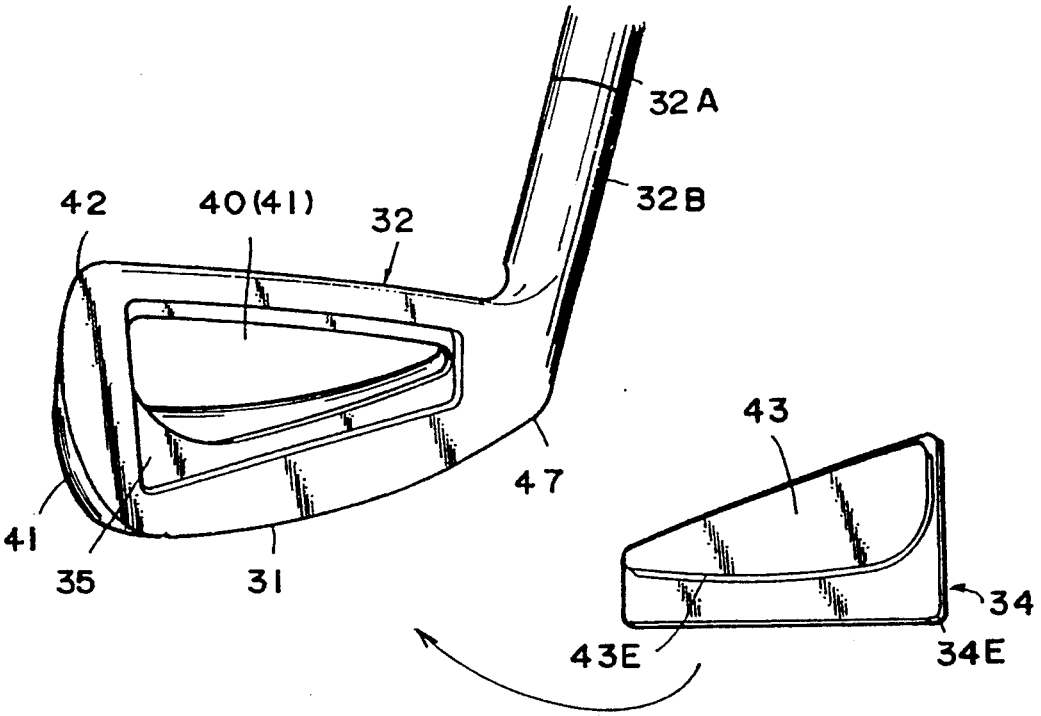
FIG. 12 is an exploded perspective view showing the structure of the fifth embodiment.

In the fifth embodiment shown in FIGS. 11 to 12, head body 32 is integrally provided with a sole 31 formed of metalic material with comparatively a large specific gravity such as beryllium copper alloy (with a specific gravity of approximately 8.2) or stainless steel (with a specific gravity of approximately 7.9), and the front part of said head body 32 is formed with recess 35 into which face member 34 of face 33 is fitted. And there is provided window-like hole 36 in the back of said recess 35. Said face member 34 is made of thin tabular member, for example, titanium, titanium alloy, magnesium alloy, alminium, alminium alloy, carbon fiber or the like which have specific gravities less than that of head body 32.

As shown in FIG. 12, from heel 47, there extends obliquely upward shaft mounting portion 32B to mount shaft 32A thereto. Overall width of peripheral surface 37 of said recess 35 increases toward the back of said head body 32 to form a dovetail mortise. Likewise, all around peripheral surface 39 or a part thereof of stepped portion 38 formes a space increasing toward the back of head body 32 to form a multistage dovetail mortise. Further, in the back of said window-like hole 36 is integrally provided back shell 41 which forms a hollow sealed space 40. Namely, the lower part of said back shell 41 is communicated with said sole 31, while the upper part thereof is communicated with toe (or top) 42 of head body 32 respectively. Said face member 34 is fitted into said recess 35, and the back surface of said face member 34 is provided with tenon or a projecting portion 43.

Additionally, the edges 34E of face member 34 is formed slightly larger than said peripheral surface 37 of recess 35, and likewise, the edges 43E of said tenon 43 is slightly formed larger than said peripheral surface 39 of stepped portion 38 such that face member 34 can be forced into recess 35 by means of press or the like so as to be secured to head body 32, in which case, said edge 34E of face member 34 is fitted into said peripheral surface 37, while edge 43E of said tenon 43 is fitted into said peripheral surface 39 to be firmly secured.

The fifth embodiment is advantageous in that the center of gravity G of a clubhead can be positioned at such a point further distant from face 33, being further biased toward sole 31, so that a golf clubhead with "ultra wide sweet area" can be provided. Moreover, face member 34 can be firmly secured to head body 32 by means of dovetail joint.

Figure 13:
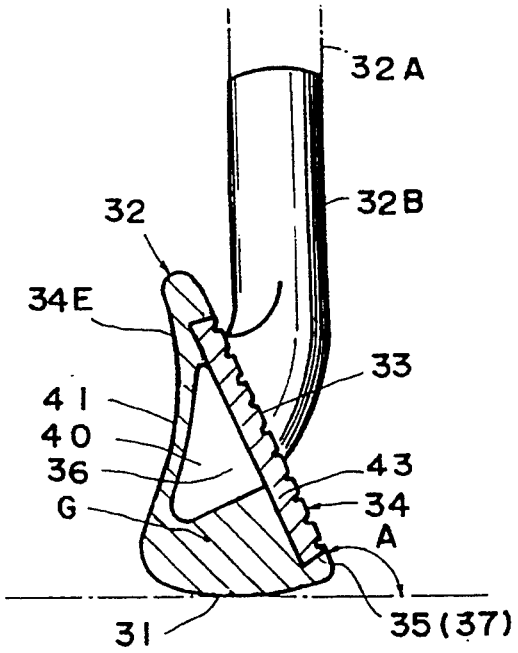
FIG. 13 is a section showing a clubhead structure according to the sixth embodiment of the present invention.
Figure 14:
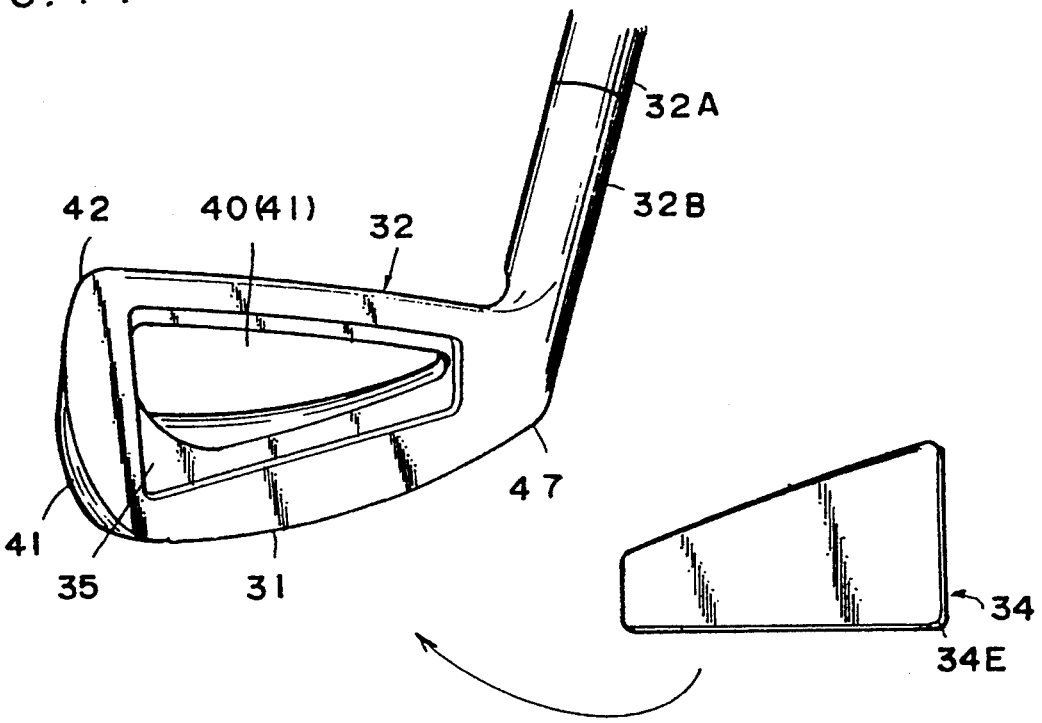
FIG. 14 is an exploded perspective view showing the structure of the sixth embodiment.

In the sixth embodiment shown in FIGS. 13 and 14, like the fifth embodiment, there is also provided window-like hole 36 in the back of head body 32. Overall width of the peripheral surface 37 of said recess 35 increases toward the back of said head body 32. In the back of said window-like hole 36 is integrally provided back shell 41 which forms a cavity or hollow sealed space 40. And face member 34 can be forced into recess 35 so as to integrally form the clubhead. The sixth embodiment is also advantageous because it can provide a golf clubhead with "ultra wide sweet area" as well as the firmly constructed structure.

Figure 15:
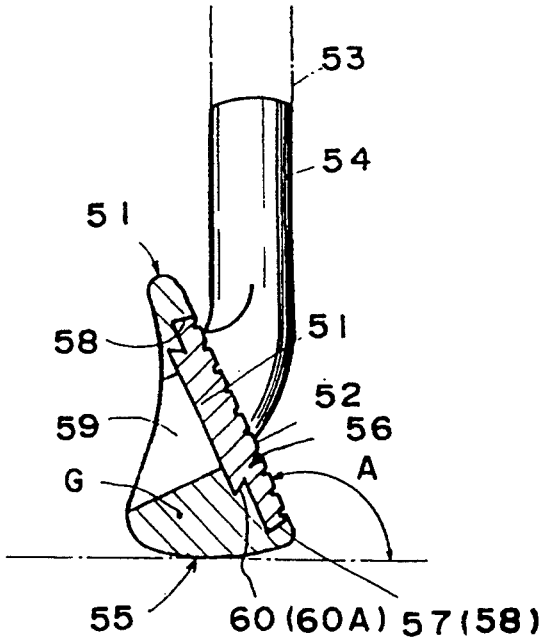
FIG. 15 is a section showing a clubhead structure according to the seventh embodiment of the present invention.
Figure 16:
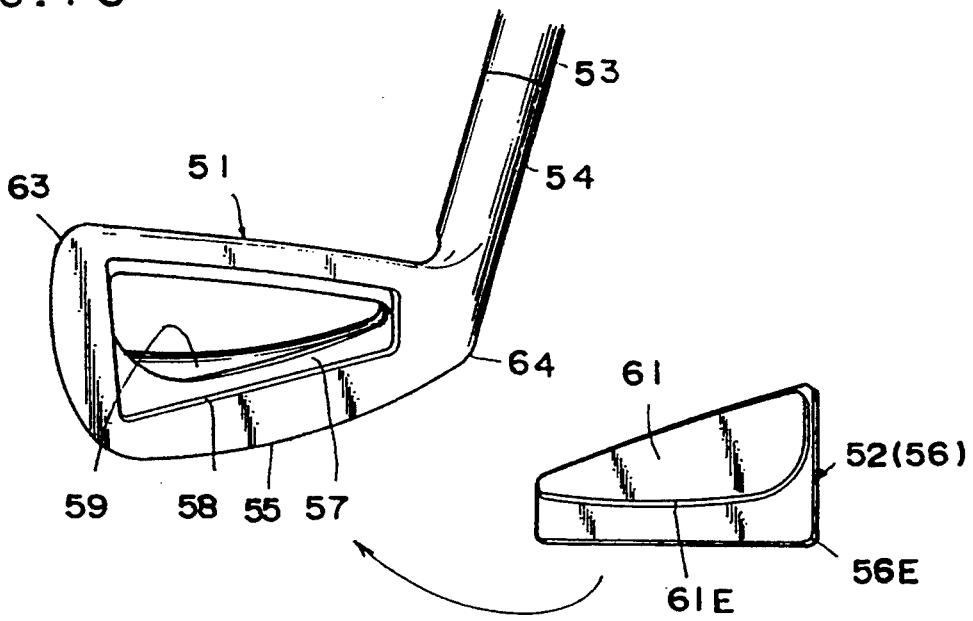
FIG. 16 is an exploded perspective view showing the structure of the seventh embodiment.

In the seventh embodiment shown in FIGS. 15 and 16, head body 51 made of metal material with comparatively a large specific gravity such as beryllium copper alloy (with a specific gravity of approximately 8.2) or stainless steel (with a specific gravity of approximately 7.9) or the like is provided with sole 55, and the front part of said head body 51 is formed with recess 57 into which face member 56 is fitted. Said face member 56 is made of thin tabular member, for example, titanium, titanium alloy, magnesium alloy, alminium, alminium alloy, carbon fiber or the like which have specific gravities smaller than that of head body 51. Overall width of the peripheral surface 58 or a part thereof of said recess 57 increases toward the back of said head body 51. Likewise, overall width of edges 56E of said face member 56 is formed slightly larger than that of said peripheral surface 58 of said recess 57. In the back of said recess 57 is provided window-like hole 59, which is provided with stepped portion 60 therein, of which the all around peripheral surface 40A or a part thereof formes space increasing toward the back of said head body 51. The back surface of said face member 56 is provided with tenon 61 or a dovetail projecting portion, which is formed slightly larger than said stepped portion 60 such that face member 56 can be forced into recess 57 by means of press or the like so as to integrally form the clubhead.

With the structure thus made, the center of gravity of head body 51 is biased toward sole 55, being distant from face 52, so that the distance between face 52 and the center of gravity G is elongated. Consequently, a golf clubhead with "ultra wide sweet area" can be provided. Furthermore, said face member 56 can be firmly secured to said head body 51 by means of dovetail joint.

Figure 17:
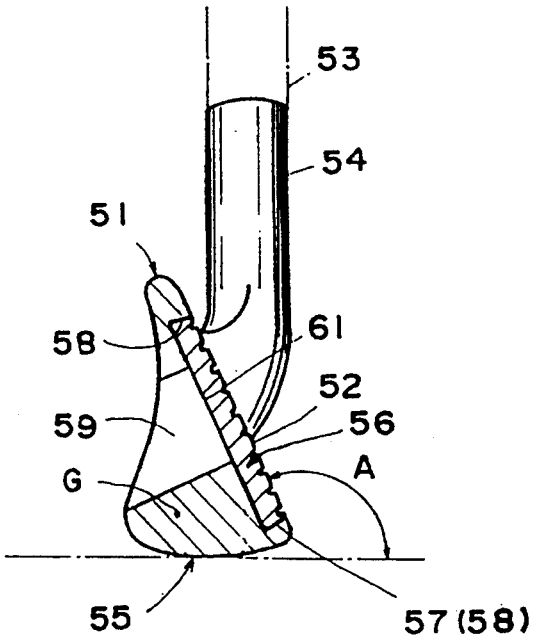
FIG. 17 is a side view showing a clubhead structure of the eighth embodiment of the present invention.
Figure 18:
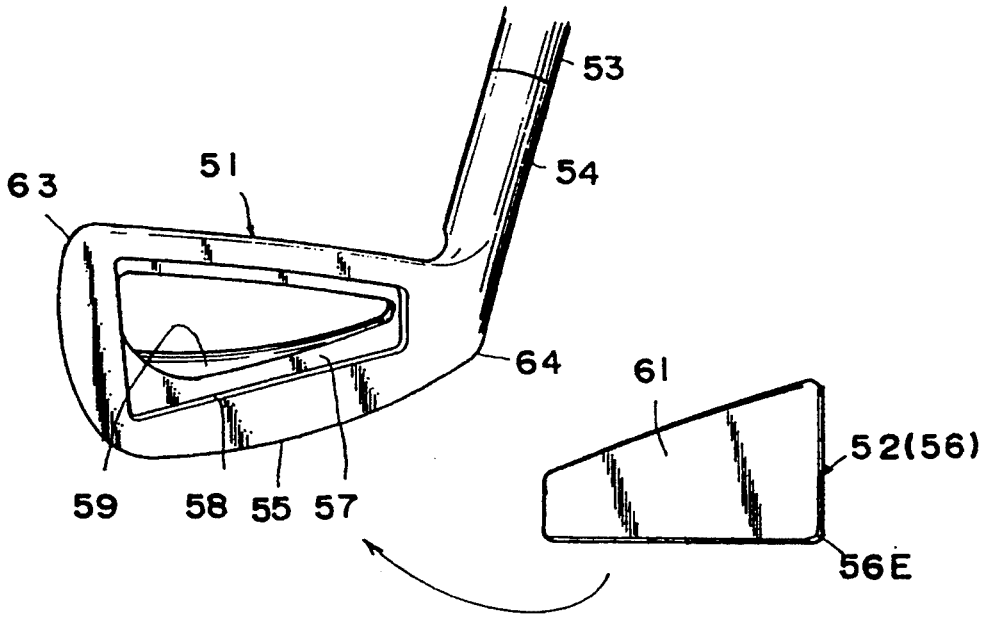
FIG. 18 is an exploded perspective view showing the clubhead structure of the eighth embodiment.

In the eighth embodiment shown in FIGS. 17 and 18, like the seventh embodiment, there is also provided recess 57, into which face member 56 is to be fitted. And said face member 56 and recess 57 are formed such that the former may be integrated with the latter by means of dovetail joint.

The eighth embodiment is advantageous as well as the seventh embodiment, and in particular, allows a golf clubhead with "ultra wide sweet area" to be easily manufactured.

The present invention should not be limited to the embodiments described above, but may be modified within the scope thereof.

For example, the combinations of metalic materials with different specific gravities are not limited to those of the embodiments, but may be other combinations.

What is claimed:

1. A golf club iron head, comprising:

a head body having a front-facing face surface and a rear-facing back surface which has a convex portion which extends rearwardly for a first distance and which does not occupy the full lateral extent of the back surface, the convex portion laterally having first and second wide areas with a first narrow area therebetween;

wherein, the first and second wide areas have upper and lower edges which are formed to provide areas with a tenon shape;

a balance weight which has a mating surface with a concave portion extending rearwardly for a second distance and which does not occupy the full lateral extent of the mating surface, the second distance approximately corresponding to the first distance, said concave portion having in lateral sequence a second narrow area, a third wide area, a third narrow area and a fourth wide area;

wherein the second and third narrow areas have upper and lower edges which are formed to provide areas with a mortise shape; and wherein the concave portion of the balance weight and the convex portion of the head body are sized and shaped so that the concave wide areas can fit into the convex wide areas and the concave narrow areas can fit into the convex narrow areas so that lateral relative movement between the convex portion and the concave portion aligns at least one narrow area and wide area, thereby affixing the balance weight to the head body in a mortise/tenon joint.

2. A golf club iron head having a heel side and a toe side laterally opposite the heel side, comprising;

a head body having a front-facing face surface and a rear-facing back surface having a dovetail convex portion which extends rearwardly;

a balance weight which forms a sole of the golf club head and which has an aperture completely through the balance weight and is adapted to mate with the dovetail convex portion of the head body;

wherein a peripheral edge of the aperture is formed so that the aperture has decreasing longitudinal width moving from back to front so that said weight can be securely fitted onto said dovetail convex portion.

3. A golf club iron head having a front-facing face and a back rearwardly opposite of the face, comprising:

a head body which forms a sole and which has a front-facing aperture, said aperture having at least one slanted peripheral edge which, in a front-to-back direction, causes the width of the aperture first to increase then to decrease so that a front peripheral surface extending from the end of the peripheral edge toward a center of the aperture can form a stepped portion at the front thereof;

a face member which forms said face and which has at least one slanted peripheral edge corresponding to that of the aperture and is adapted to be securely fitted into said aperture;

a back shell provided at the back of said head body, said back shell and the face member defining a hollow sealed space.

4. A golf club iron head according to claim 3, wherein a front-to-back direction, said aperture has at least two slanted, stepped peripheral edges;

wherein said two slanted, stepped peripheral edges comprise a first peripheral edge which, in a front-to-back direction causes the width of the aperture to increase, a first front stepped surface extending from an end of the first peripheral edge toward a center of the aperture, a second peripheral edge which in a front-to-back direction causes the width of the aperture to increase again, and a second front stepped surface extending from an end of the second peripheral edge toward a center of the aperture; and wherein said face member comprises a first peripheral edge which corresponds to the first peripheral edge of the aperture, a first stepped back surface which corresponds to the first stepped surface of the aperture, a second peripheral edge which corresponds to the second peripheral edge of the aperture; a second stepped back surface which corresponds to the second front stepped edge of the aperture, thereby securely fitting the face member into the aperture.

5. A golf club iron head having a front-facing face and a back rearwardly opposite of the face, comprising:

a head body which forms a sole and which has a front-facing aperture, said aperture having at least one slanted peripheral edge which, in a front-to-back direction, causes the width of the aperture first to increase then to decrease so that a front peripheral surface extending from the end of the peripheral edge toward a center of the aperture can form a stepped portion at the front thereof;

a face member which has a back side and opposite it a front side which forms said face and which has at least one slanted peripheral edge corresponding to that of the aperture and is adapted to be securely fitted into said aperture;

wherein said aperture extends completely through the head body so that at least a portion of the back side of the face member is exposed.

6. A golf club iron head according to claim 5, wherein in a front-to-back direction, said aperture has at least two slanted, stepped peripheral edges;

wherein said two slanted, stepped peripheral edges comprise a first peripheral edge which, in a front-to-back direction causes the width of the aperture to increase, a first front stepped surface extending from an end of the first peripheral edge toward a center of the aperture, a second peripheral edge which in a front-to-back direction causes the width of the aperture to increase again, and a second front stepped surface extending from an end of the second peripheral edge toward a center of the aperture; and wherein said face member comprises a first peripheral edge which corresponds to the first peripheral edge of the aperture, a first stepped back surface which corresponds to the first stepped surface of the aperture, a second peripheral edge which corresponds to the second peripheral edge of the aperture; a second stepped back surface which corresponds to the second front stepped edge of the aperture, thereby securely fitting the face member into the aperture.

* * * * *